United States Patent [19]

Kelly

[11] 3,958,422

[45] May 25, 1976

[54] ROTARY STIRLING CYCLE ENGINE SYSTEMS

[76] Inventor: Donald A. Kelly, 58-06 69th Place, Maspeth, N.Y. 11378

[22] Filed: Oct. 24, 1974

[21] Appl. No.: 517,507

[52] U.S. Cl. ..... 60/525
[51] Int. Cl.[2] ..... F02G 1/04
[58] Field of Search ..... 60/516–526

[56] References Cited

UNITED STATES PATENTS 3,744,245 7/1973 Kelly ..... 60/671

*Primary Examiner*—Allen M. Ostrager

[57] ABSTRACT

The rotary Stirling cycle engine system consists of multiple rotary units mounted together for a combined power output. Each rotary unit is comprised of an eccentric rotor, multiple vane rotary engine which is independent from adjacent units in a modular arrangement.

Heat transfer is accomplished by multiple heat transfer tubing loops located on either side of each rotary unit, with heating and cooling sources in close proximity to the tubing loops.

Both internal and external regeneration techniques are utilized to improve overall performance and efficiency.

Hydrogen is the internal working gas and any suitable fuel may be used to heat the engine system.

10 Claims, 6 Drawing Figures

ROTARY STIRLING CYCLE ENGINE SYSTEMS

BACKGROUND OF THE INVENTION

The rotary Stirling cycle engine system is similar to previously disclosed rotary closed cycle power systems, with large lateral tubing loops located between the hot and cold sources.

This present engine system is nearly identical to previous rotary closed parallel cycle engine system with the exception of the sealing of the rotary units and external tubing loop configurations. The parallel or independent heat transfer tubing arrangement is an improvement over the series gas flow design, when a positive displacement return pump is placed between the two lateral tubing loop groups.

The addition of the rotary return pump insures that the expanding gas in the hot section is kept under pressure and forced into the rotary engine unit, while a suction is created within the the cooling tubing loops and aids in the evacuation of the spent gas within the "cold" engine half. The rotary pump — is driven by a takeoff belt drive from the rotary engine units and must be a low inertia type to minimize the power drain from the system.

The major difference within the rotary engine units previously disclosed and in this design is that the multiple vanes were not sealed, but revolved at a close clearance to the cylinder bore and side walls of each rotary engine unit. Without sealing the rotary closed cycle engine operates closer to the closed Brayton (turbine) cycle with high gas flow rates, and a lower compression ratio.

The present Stirling cycle engine system with sealed vanes operates at higher compression ratio and lower gas flow velocity than all non-contacting vane engines, and will produce greater torque per BTU input for equivalent sized engines. The rotary Stirling cycle engine is a more desirable gaseous power source becuse of the lower gas flow rates which allow more effective heat transfer for both the hot and cold sources.

When considered from another standpoint, the rotary Stirling will allow shorter heat transfer loops and therefore greater compactness than an equivalent Brayton closed cycle power source.

An important difference in the rotary engine units in this present engine design is the addition of small sleeve (oilite) rollers within the rotors, adjacent to each vane slot. These small rollers secured to the inside side faces of the rotor prevent the vanes from rubbing on the edge surfaces of each slot, so that friction at these points is reduced.

This lower friction, when combined with lower sliding friction of the vane guidance rings result in a closed cycle rotary engine unit of high efficiency and long operating life.

The problem of regeneration within a rotary Stirling engine has been a difficult one to resolve in the past, and it has not been possible to achieve the effectiveness of reciprocating regeneration of the piston type Stirling engine. It is now believed that the effectiveness of reciprocating regeneration can be approached for the rotary version by a combination of internal bypass regeneration and by external heat collection and return regeneration techniques.

Hydrogen, or possibly helium, will be the internal working medium for the rotary engine system which have been successfully used in the piston type of Stirling cycle engine. Hydrogen gas may also be used as the external fuel source, although any type of fuel for the heat source may be employed.

SUMMARY OF THE INVENTION

The rotary Stirling cycle engine system consists of multiple identical cylindrical housings with eccentrically located vaned rotors revolving in sealed housings. The rotary engine configuration is based on the simple Ramelli rotary pump which is used in many commercial pump applications.

Within the rotary units, multiple light-weight, hollow vanes are all guided in corresponding concentric grooves located in each of the two end plates, so that light seal contact is maintained with the cylinder bore and side walls for minimum friction and wear. Each seal may be lightly spring-loaded if necessary to maintain leak-free contact with the bore and side walls.

The multiple vanes also roll in and out of the rotor slots on multiple small diameter sleeve rollers, so that friction is reduced at these points. The slotted rotor is built up with partitions so that each slot is sealed from the others, in order that no leakage of gas occurs through the rotor.

The parallel and independent multiple heat transfer tubing loop arrangement provides that the hot and cold side manifold of each cylinder is directly connected at right angles to the engine system axis.

A relatively large number of small diameter tubing lengths connect the hot and cold manifolds on either side of each unit, in a wide loop arrangement for effective heat transfer from the hot and cold sources.

One lateral half of the tubing loops are contained within a burner housing, while the opposite lateral half of the tubing loops are in tangent contact with circulating coolant tubing and multiple fins for heat sinking and cooling of the internal gas flow. The "hot" loops are in parallel, while the cold loops are seried.

In addition to multiple sets of forward to aft tubing loops, each loop makes a full circle so that adequate heat transfer is provided for the heating of the internal working gas.

The difference in the heat transfer tubing loop configuration in this design arrangement is that a gravity feed return flow is provided for the cooling gas flow. The hot side tubing loops are inverted with the multiple loops approximately horizontally inline with the rotary engine units, while the opposide side cooling tubing loops are above the rotary units by nearly the basic diameter of the tubing loops.

This arrangement provides a slight preformance improvement for the gas flow within the heat transfer tubing and allows a means of keeping the hot side of the rotary unit cylinder exposed to a continuous heat flow from the burners, unlike previous designs. Heat storage provision is made adjacent to the hot engine side to retain heat energy, for improved heating economy.

To further improve heat transfer performance, the cold side tubing loops are fabricated of larger diameter, thin wall tubing to aid in heat sinking and more rapid gas cooling. The diameter and wall thickness of the cold side tubing must be compatible with the highest working pressure at the cold side of the rotary units. The cold tubing loops are continuous or seried.

An alternate arrangement for the cold side heat transfer tubing would be the application of expansion type cooling loops, whereby uniformly increasing diameters of tubing of nearly equal lengths are joined from the cold manifold to the entrance side of the rotary return pump. The spent gas flowing through the expansion tubes are cooled by both expansion and by exposure to increasing heat transfer surface areas of thinner wall thickness, for more rapid heat conduction.

A critical component in the proper functioning of the engine system is the rotary, low-inertia return pump, which is located at the top center of the rotary unit(s) between the heat transfer tubing loops. Each rotary engine unit in the system has its own rotary return pump.

The rotary return pump(s) consist of the multiple vane,/slotted rotor type, which is generally similar to the engine rotary units, which are belt driven at a suitable speed from the engine system drive shaft(s).

A pressure snubber is secured to the hot side of the rotary return pump to dampen any sudden pressure surges which may occur within the hot side of the heat transfer tubing loops, to relieve the return pump of this sudden pressure load.

The internal regeneration arrangement for this rotary type of Stirling cycle engine will consist of partial cold side bypass of the hot expanding gas, so that this partial gas flow may be returned to the hot side manifold for reentry into the hot expansion phase of the cycle.

Rotary by-pass partial regeneration will accomplish two results:

1. A portion of the hot gas flow will be saved for a slight working presure increase at the hot manifold.
2. Some pressure relief will occur at the start of the cold phase, so that the rotor torque effectiveness is extended into the cold phase of the cycle.

Partial rotary regeneration is accomplished by providing external circular ducts on each end plate which connect the start of the cold phase with the start of the hot expansion phase over an approximate 160° circular gas flow path.

The twin ducts or tubes are secured to each end plate, with the hot gas flowing in the same direction as the internal working gas flow. A positive pumping function must be included for rotary partial regeneration for the Stirling cycle, since the bypassed gas flow must be returned against a high pressure at the hot side manifold.

The pumping function for rotary regeneration is provided by a centrally located vaned grove within the rotor. The ducts or tubes enter the top periphery of the engine cylinder near the top center and lineup with the central vaned groove. Nearly positive gas displacement is achieved by the rotating, thin and flat vanes within the central groove of the rotor.

It is important that the ducts or tubes which are mounted on the two end plates be thermally isolated from the plates, so that no thermal exchange occurs between the regenerative gas flow and the internal "cooling" gas volume. Slanted, small multiple bores are located at both the regenerative gas flow exit and entrances for smooth, unbroken gas flow, with exit and entrance transition pads provided for the tubing connections. The ducts or tubes will bend over the end plates at the top of the rotary unit cylinder for entrance into the central vaned groove and on into the hot expansion zone.

External regeneration consists of a heat collection shell which covers the top portion of the cold tubing loops to collect the heat rejected from the cold tubing loops. A regenerator canister or unit is mounted between the rotary return pump and the burner housing which is connected to the heat collection shell by means of a conduction duct.

The external regeneration means is effective as a preheating source for the entering gas flow from the rotary return pump so that the heat level within the burner may be kept at the lowest possible level compatible with full gas pressure, for the hot expansion phase of the cycle.

By combined internal and external regeneration means coupled with heat storage compartments at key locations, the effectiveness of Stirling cycle reciprocating regeneration can be approached for the rotary engine version.

To produce useful torque output at least four rotary units must be utilized, with each one independent and individually sealed for maximum reliability. Each rotary unit has its own burner housing and burner unit which enclose the hot half portion of the multiple heat transfer tubing loops, for the required heat flow to pressurize the working gas.

A combined liquid and air cooling means must be utilized for the cold half portion of the multiple heat transfer tubing loops. Several small diameter liquid coolant lines will be in tangent contact with each cold transfer tube, with uniformly placed fins assembled over the combined tubing, which also serve to fasten the tubing lines together. Forced air cooling may also be provided over the tubing lines by means of one or more fans.

Thermal storage chemical compartments are located at key areas within the burner housing, hot manifold and other possible points of the engine system, to provide long heat containment for the hot expansion phase of the engine cycle.

A variable pressure reservoir will be required as a means of rapidly varying the torque output of the engine system on demand.

The units or modules will be axially connected by splined or flexible couplings, with a front drive shaft and rear accessory shaft provided. Each unit will be secured to the adjacent units with four or more outer spacers positioned to insure correct alignment. The outer spacers are secured to corresponding brackets on each rotary unit, so that a quick mounting method is provided.

A dynamo may be connected to the rear shaft extension for alternately starting the rotary engine system, and for electric power generation during normal engine operation.

It is a principal object of the invention to produce a rotary Stirling cycle engine system which converts thermal energy into mechanical shaft power, at the best possible cost/effectiveness ratio.

All other objectives of this invention have been previously defined in the background and summary description of the specifications.

It should be understood that variations may be made in the detail design of the rotary Stirling engine system, without departing from the spirit and scope of the invention as specified.

Several Disclosure Documents have been filed with the Office, which describe portions of this rotary Stirling cycle engine. Disclosure Document Numbers:

1. 026,461 — Rotary Closed Cycle Engine
2. 026,649 — Rotary Closed Parallel Cycle Engine Sys.
3. 026,801 — Rotary Closed Cycle Engine

4. 026,861 — Peripheral Regenerator for Rotary c/c eng.
5. 026,841 — Rotary By-pass Regenerator
6. 027,250 — Rotary Stirling Cycle Engine System.

The following issued U.S. patents also contain features and information pertinent to this present invention.

1. No. 3,370,418 — Rotary Stirling Cycle Engine
2. No. 3,492,818 — Rotary Stirling Cycle Engine
3. No. 3,488,945 — Rotary Stirling Cycle Engine
4. No. 3,537,256 — Rotary Stirling Engine

DESCRIPTION OF THE PREFERRED EMBODIMENT

Figure 1:
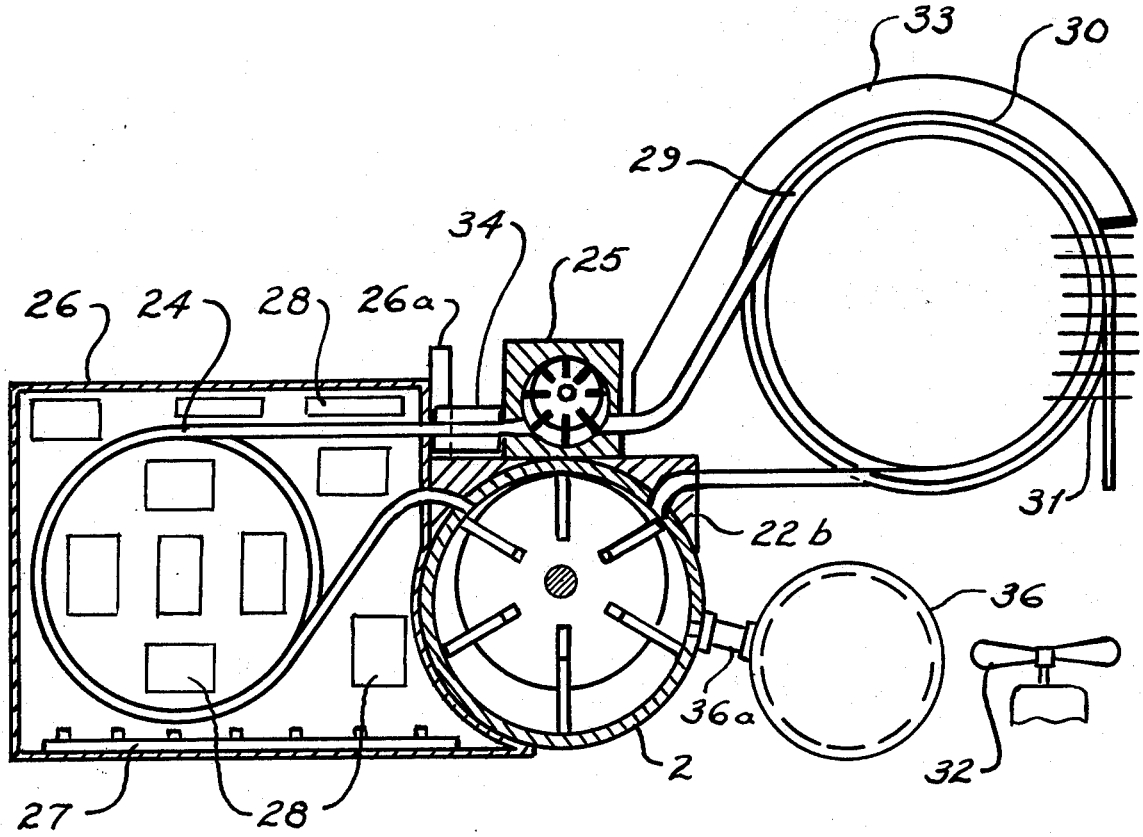
FIG. 1 is a front sectional view through the rotary Stirlin cycle engine system.
Figure 2:
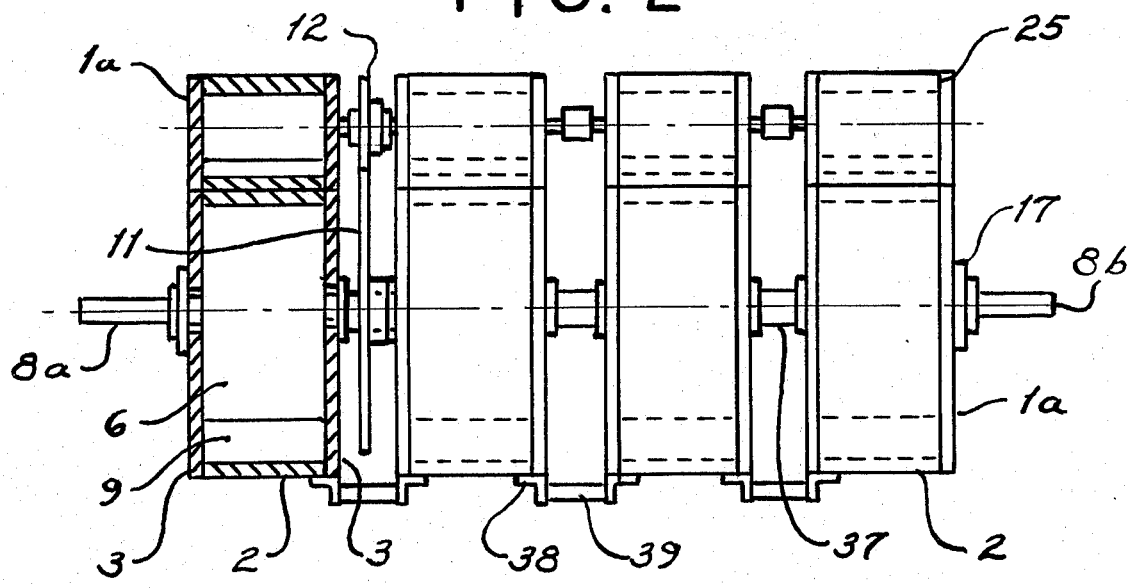
FIG. 2. is a side view of the rotary units joined as an engine system.
Figure 3:
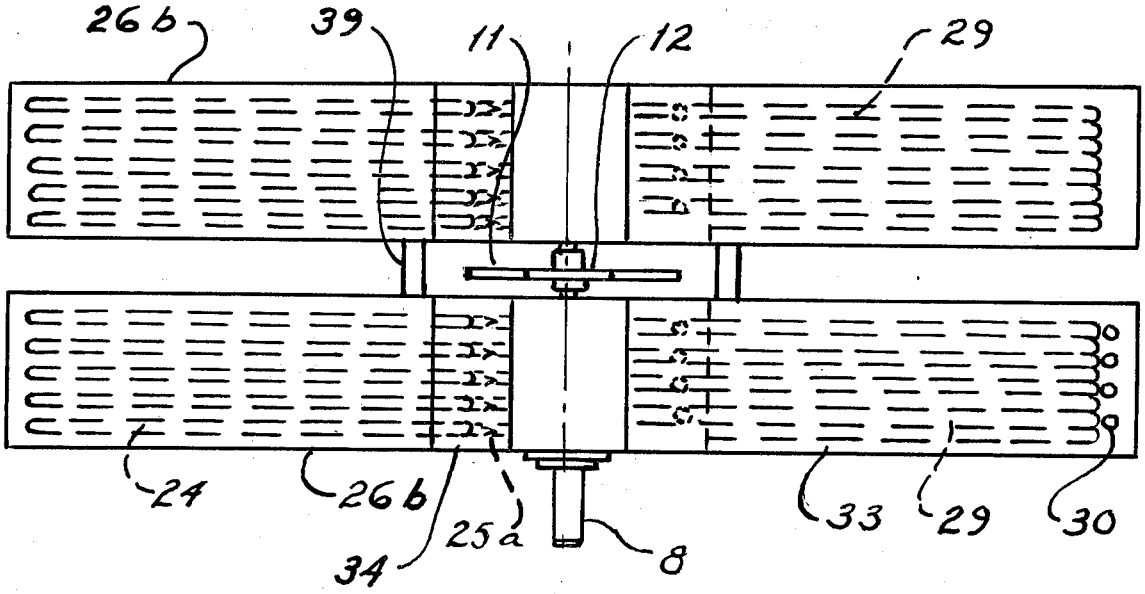
FIG. 3. is a top view of the rotary units joined as an engine system.
Figure 4:
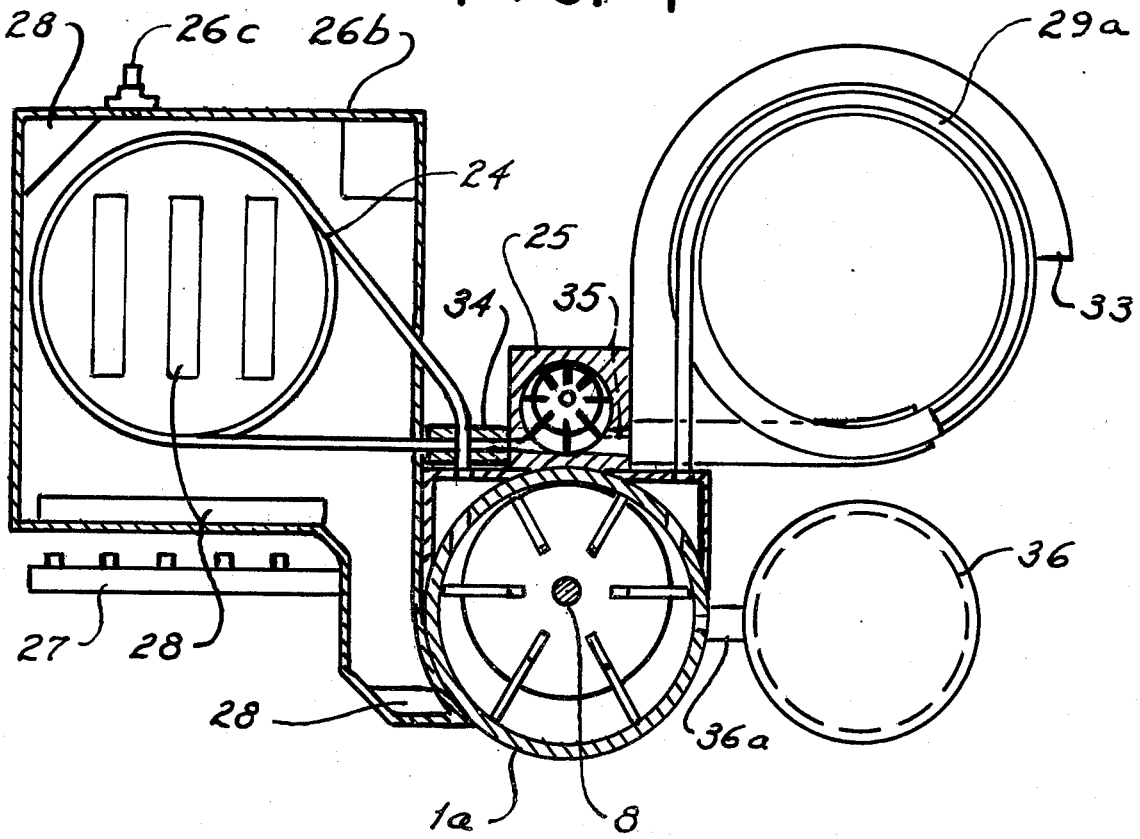
FIG. 4 is a front view of an alternate arrangement of the cold side tubing loops.
Figure 5:
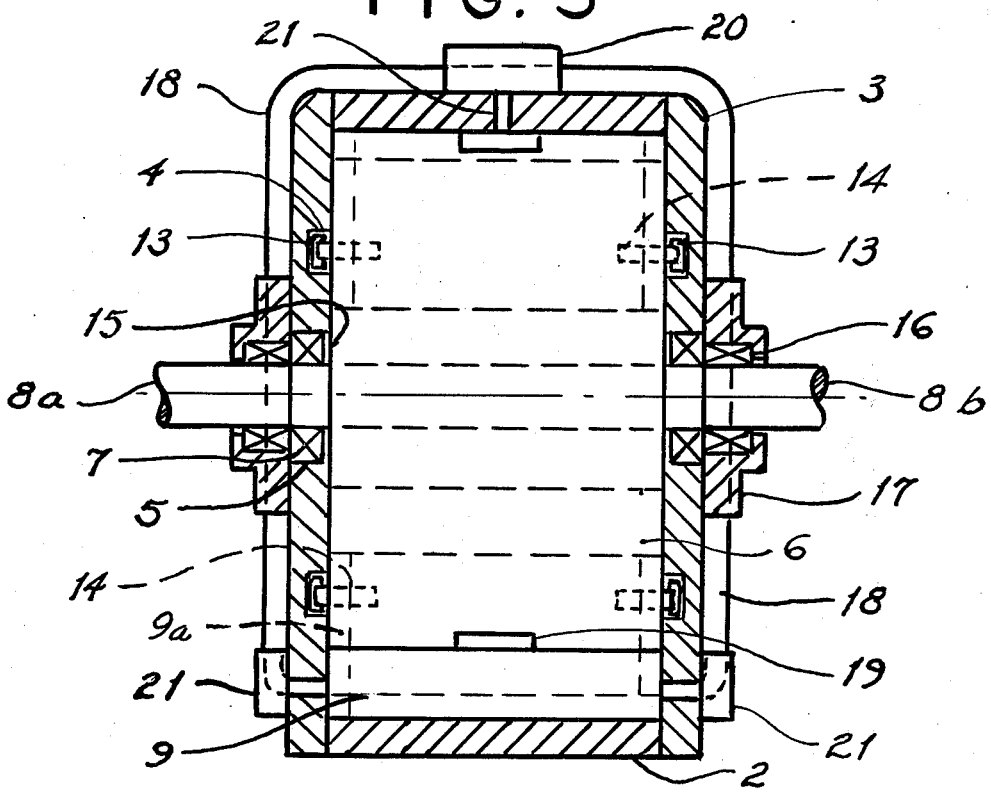
FIG. 5. is a side sectional view of one rotary unit.
Figure 6:
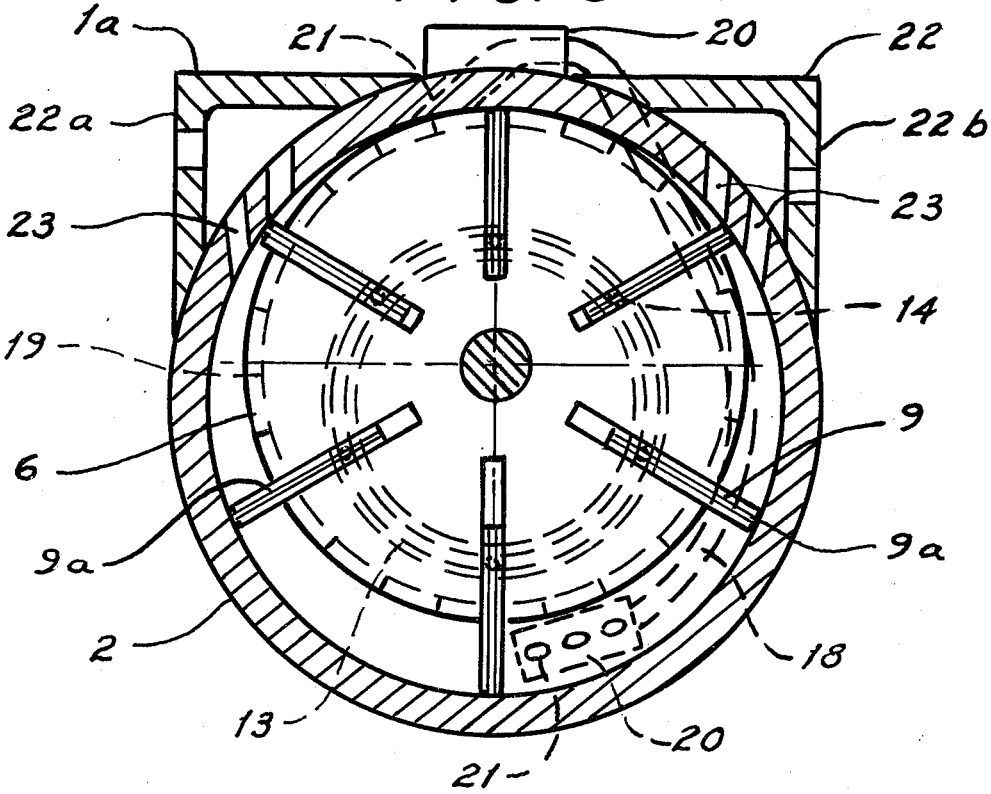
FIG. 6. is a front sectional view of one rotary unit.

The rotary Stirling cycle engine system 1, consists of multiple, identical rotary units 1a, which are comprised of cylindrical housings 2, and two identical end plates 3.

The two end plates 3, are provided with concentric internal circular grooves 4, which serve as clearance means for 2 guide rings on the vanes. The end plates 3, also are provided with the eccentric bearing bore 5.

Each unit 1*a*, contains a close fitting, freely revolving slotted rotor 6, which is supported by two needle bearings 7, closely fitted into the bearing bores 5, by means of the drive shaft 8.

Multiple, identical sliding vanes 9, are uniformly fitted into corresponding slots 10, within the slotted rotor 6. The slot surfaces are coated with graphite to reduce sliding friction as the vanes move in and out of the slots 10.

Two identical guide-rings 13, are located in-line, at the sides of each vane 9, and secured to the vanes by the pins 14. Each guide-ring 13, revolves with the vanes, within the circular grooves 4, so that the multiple vanes 9, are guided in radial travel as the rotor 6, revolves within the cylindrical housing 2.

Vane seals 9*a*, are positioned within thin slots on the three sides of the multiple, identical sliding vanes 9.

Thin spacers 15, are provided between the slotted rotor 6, and the inside faces of the two identical end plates 3, with the thin spacers 15, centered on the drive shaft 8. The side clearance for each vane 9, is maintained by free fitted side seals 9*a*, in relation to the inside faces of the two identical end plates 3.

Gas pressure seals 16, are located within sealing plates 17, which are secured to the outside faces of the two identical end plates 3. The gas pressure seals 16, must contain the high internal working pressure of each rotary unit 1a.

The internal regenerator for the engine system 1, consists of a hot gas by-pass method using twin external, circular ducts 18, which connect the lower, cold engine cylinder portion with the upper hot portion of the cylinder, over approximately 160° of circular gas flow path.

The pumping function for the regenerator is provided by a finned groove 19, centrally located on the slotted rotor 6, periphery.

The twin circular ducts 18, are located on either side of the end plates 3, and line up with the central finned groove 19, by means of a transition pad 20. Slanted bores 21, connect the internal gas volume with the twin circular ducts 18, to complete the hot gas flow paths.

Two identical manifolds 22, are secured at the upper sides of the cylindrical housing 2. The manifolds 22, are separated into a hot manifold 22*a*, and cold manifold 22b. Rectangular ports 23, are located within the upper sides of the cylindrical housing 2, which line up with the two manifolds 22*a* and 22*b*.

Multiple small hot transfer tubes 24, connect the hot side manifold 22*a*, with the exit side of the rotary return pump 25. Pressure snubbers 25*a*, are fitted between the hot transfer tubes 24, and the rotary pump 25, to prevent pressure surges at the rotary pump 25. Gear 11 & pinion 12, connect pump 25 & unit 1*a*.

The hot transfer tubes 24, are arranged in multiple, parallel loop circuits, for most effective heat transfer from the heat source.

A burner housing 26, will enclosed the entire group of hot transfer tubes 24, so that maximum heat containment is achieved for rapid heat flow to the parallel tubing loops. The burner housing 26, is in close contact with the full hot side of the cylinder housing 2, for allowing heat flow into this gas volume.

Multiple burners 27, are located at the base of the burner housing 26, to produce the constant heat flow to the parallel hot transfer tubes 24. Heat storage chemicals 28, are uniformly located within the burner housing 26, for heat containment and economy. A flue duct 26*a*, is provided adjacent to the cylindrical housing 2.

A continuous or series cooling tubing circuit 29, consisting of coupled tubular sections or flexible interlocking metal hose connects the cold side manifold 22b, with the entrance side of the rotary return pump 25, to complete the closed cycle loop.

The continuous or series flow cooling tubing loops 29, are formed starting near the center of the cold manifold 22*b*, and are coiled in uniform-diameter loops, ending near the top of the final loop for entrance into the rotary return pump 25.

As an alternate arrangement, the continuous cooling tubing loops may be formed of uniformly increasing diameters of tubing or flexible metal hose 29*a*, so that an expansion cooling effect is provided for the cooling of the circulating gas flow.

A circulating coolant tubing arrangement 30, is in close, tangent contact with the continuous cooling tubing loops 29, to maintain the necessary heat sinking rate or uniform cooling of the circulating working gas.

Multiple flat fins 31, secure both sets of tubing runs, the continuous cooling tubing loops 29, and circulating coolant tubing 30, together. Cooling fans 32, may also be utilized for cooling.

The external regeneration method for the engine system 1, is comprised of a heat collection shell 33, which covers the top portion of the cooling tubing circuit 29, to collect the upward rejected heat flow from the cold tubing loops 29.

A regeneration canister - 34, is placed between the rotary return pump 25, and the burner housing 26, and is connected to the heat collection shell 33, by means of the conduction duct 35.

A variable pressure reservoir 36, is provided for rapidly varying the working pressure of the working gas, on demand. Connecting pressure tubes 36*a*, connect the variable pressure reservoir 36, to each of the multiple identical rotary units 1a.

The multiple rotary units 1a, are axially joined at the output shaft 8, by flexible couplings or splines 37, at shaft extensions 8*a* and 8*b*, for the front and rear rotary units, respectively.

Four outer brackets 38, are secured to the outer surface and ends of the cylindrical housing 2, which secure the spacers 39, for joining each rotary unit 1*a*. Standard hardware joins the brackets 28 and spacers 39 together.

In an alternate heating arrangement the multiple small hot transfer tubes 24, are fully enclosed and sealed within a sealed and pressure safe heat transfer housing 26*b*, containing a — fluid heat transfer medium.

The multiple burners 27, will be located under the sealed heat transfer housing 26*b*. A safety pressure relief valve 26*c*, will be provided at the top of the heat transfer housing 26*b*.

What is claimed is:

1. A rotary Stirling cycle engine system comprising multiple identical rotary units consisting of eccentric rotors and multiple vanes revolving within sealed cylindrical housings, two identical end plates secured to each end of said sealed cylindrical housings including concentric circular grooves uniformly disposed on the inside faces of said end plates, a uniformly slotted rotor eccentrically and tangentially disposed within each of said sealed cylindrical housings, multiple flat and hollow rectangular vanes in sliding contact with the slots of said uniformly slotted rotor, multiple non-metallic seals uniformly fitted into corresponding grooves within the top and two sides of multiple flat and hollow rectangular vanes, cylindrical pins disposed on either side of said multiple flat and hollow rectangular vanes near the lower end, grooved guidance rings disposed on either side of said multiple flat and hollow rectangular vanes in sliding contact with all of said cylindrical pins, two low-friction discs disposed on either side of said uniformly slotted rotor between said two identical end plates, a drive shaft concentrically disposed through said uniformly slotted rotor supported by two bearings eccentrically disposed within each of said two identical end plates, multiple gas pressure seals disposed on the inner and outer faces of each of said two identical end plates and over said drive shaft, a hot gas manifold and cold gas manifold secured at the upper opposite sides of each of said sealed cylindrical housings, multiple gas transfer ports disposed at the upper sides of said sealed cylindrical housings in direct communication with said hot and cold gas manifolds, a small high speed rotary return pump disposed directly above said sealed cylindrical housings with drive shaft connection means to said drive shaft, multiple small diameter tubing loops in parallel groups disposed between said hot gas manifolds and said rotary return pump nearly laterally in line with said sealed cylindrical housings, a burner housing disposed over the complete groups of said multiple small diameter tubing loops, multiple burners uniformly located at the base of said burner housing, multiple small diameter tubing loops in several lateral-series gas flow paths disposed between said cold gas manifold and said rotary return pump above said sealed cylindrical housings, multiple outer mounting brackets secured to the outer surface and ends of said sealed cylindrical housings, multiple spacers disposed adjacent to said multiple outer mounting brackets secured by multiple mounting hardware, standard fastening and sealing means utilized for joining and sealing of components of said rotary Stirling cycle engine system.

2. A rotary Stirling cycle engine system according to claim 1, wherein the said uniformly slotted rotor contains a central peripheral groove fitted with uniformly spaced flat vanes, twin external semi-circular tubing ducts secured to the outside faces of said two identical end plates, said twin external semi-circular tubing ducts connecting the lower central portion of said sealed cylindrical housing with the upper hot portion of said sealed cylindrical housing over the cold portion for about 160°, said twin external semi-circular tubing ducts connected to transition pads at the top center of said sealed cylindrical housings, lower connections made to transition pads on the lower portions of said two identical end plates, small diameter slanted bores disposed within said sealed cylindrical housings and said two identical end plates in direct communication with said transition pads, said transition pad at the top center of said sealed cylindrical housing lines up with said central peripheral groove within said uniformly slotted rotor.

3. A rotary Stirling cycle engine system according to claim 1, in which an external heat collection shell is disposed over the top portion of said multiple small diameter tubing loops in several lateral series gas flow paths, a regenerator canister disposed between said burner housing and said small high speed rotary return pump in communication with the internal returned gas flow, a metallic conduction duct disposed between said heat collection shell and said regeneration canister.

4. A rotary Stirling cycle engine system according to claim 1, including multiple circulating coolant tubing loops in tangent contact with said multiple small diameter tubing loops in several lateral series gas flow paths, multiple flat metallic fins joining said multiple circulating coolant tubing loops to said to said multiple small diameter tubing loops in several lateral series gas flow paths, multiple air circulating fans disposed under said multiple small diameter tubing loops in several lateral series gas flow paths directing air flow upward toward said rotary Stirling cycle engine system.

5. A rotary Stirling cycle engine system according to calim 1, wherein said burner housing includes heat storage chemicals. in uniform compartmants, said burner housing is in full close contact with one-half hot side of said sealed cylindrical housings, a flue means is provided adjacent to and in communication with said burner housing and burners, pressure snubbing means are disposed within said multiple small diameter tubing loops in parallel groups between said rotary return pump and said burner housing.

6. A rotary Stirling cycle engine system comprising multiple identical rotary units consisting of eccentric rotors and multiple vanes revolving within sealed cylindrical housings, two identical end plates secured and sealed to each end of said sealed cylindrical housing, a uniformly slotted rotor eccentrically and tangentially disposed within each of said cylindrical housings, multiple flat and hollow rectangular vanes in sliding contact with the slots of said uniformly slotted rotor, multiple low-friction flat rectangular seals uniformly fitted into corresponding grooves within the top and two sides of said multiple flat and hollow rectangular vanes, two low-friction discs disposed on either side of said uniformly slotted rotor between said two identical end plates, a drive shaft concentrically disposed through said uniformly slotted rotor supported by two by two ball bearings eccentrically located within each of said two identical end plates, multiple gas pressure seals uniformly disposed on the inner and outer faces of each of said two identical end plates over said drive shaft, a hot gas manifold secured over the top one-half of said sealed cylindrical housings, a cold gas manifold secured over the top opposite half of said sealed cylindrical housings, a small rotary return pump disposed directly and centrally above said sealed cylindrical housings with drive shaft connection means to said drive shaft, said drive shaft connection means to consist of a non-slip non-metallic belt, multiple small diameter tubing loops in parallel identical array disposed between said hot gas manifold and said rotary return pump laterally above said sealed cylindrical housings, a sealed heat transfer housing disposed over a complete unit group of said multiple small diameter tubing loops in direct close contact with one-half hot sides of said sealed cylindrical housings, a fluid heat transfer means filling said sealed heat transfer housing disposed over a complete unit group of said multiple small diameter tubing loops, multiple external burners disposed directly under said sealed heat transfer housings, multiple joined sections of uniformly increasing diameter expansion tubing loops in parallel identical units disposed between said cold gas manifold and said small rotary return pump laterally above said sealed cylindrical housings, multiple outer mounting brackets secured to the outer surfaces and ends of said sealed cylindrical housings, multiple spacers disposed adjacent to said outer mounting brackets secured by multiple mounting hardware, standard fastening and sealing means utilized for joining and sealing components of said rotary Stirling cycle engine system.

7. A rotary Stirling cycle engine system according to claim 6, in which the said uniformly slotted rotor contains a central peripheral groove fitted with uniformly spaced flat vanes, twin external semi-circular tubing ducts secured to the outer faces of said two identical end plates, said twin external semi-circular tubing ducts connecting the lower central portion of said sealed cylindrical housings with the upper central hot portion of said sealed cylindrical housings over the cold half portion for about 150°, said twin external semi-circular tubing ducts connected to transition pads at the top center of said sealed cylindrical housings, with lower connections made to transition pads on the lower portions of said two identical end plates, small diameter slanted bores disposed within said sealed cylindrical housings and said two identical end plates in direct communication with said transition pads, said transition pad at the top center of said sealed cylindrical housing lines up with said central peripheral groove within said uniformly slotted rotor.

8. A rotary Stirling cycle engine system according to claim 6, in which an external heat collection hollow shell is disposed over the top of said multiple joined sections of uniformly increasing diameter expansion tubing loops in parallel identical units, a regenerator canister disposed between said sealed heat transfer housing and said small rotary return pump in communication with the internal gas flow, a metallic conduction duct disposed between said heat collection hollow shell and said regenerator canister.

9. A rotary Stirling cycle engine system according to claim 1, in which multiple thin flat fins join the said multiple joined sections of uniformly increasing diameter expasion tubing loops in parallel identical units, multiple air circulating fans are disposed under said multiple joined sections of uniformly increasing diameter expansion tubing loops in parallel identical units, multiple circulating coolant tubing loops in tangent direct contact with a portion of said multiple joined sections of uniformly increasing diameter expansion tubing loops in parallel identical units, pressure snubbing means are disposed within the said multiple joined sections of uniformly increasing diameter expansion tubing loops in parallel identical units.

10. A rotary Stirling cycle engine system according to claim 6, including a variable pressure reservoir disposed adjacent to the said sealed cylindrical housings, gas pressure conduction tubing means connecting said sealed cylindrical housings with the variable pressure reservoir, control means for varying the working pressure of said variable pressure reservoir, joining and sealing means for said variable pressure reservoir, hydrogen gas sealed in under pressure within the said rotary Stirling cycle engine system, front and rear shaft connection means from said rotary Stirling cycle engine system, front end connection provision for the driven load with rear shaft connection provision for a dynamo of matched size and rating.

* * * * *